US005137188A

United States Patent [19]

Thompson

[11] Patent Number: 5,137,188

[45] Date of Patent: Aug. 11, 1992

[54] POURING EXTENSION FOR CANS

[76] Inventor: Terry A. Thompson, P.O. Box 705, North San Juan, Calif. 95960

[21] Appl. No.: 592,337

[22] Filed: Oct. 3, 1990

[51] Int. Cl.[5] ..... B65D 25/40

[52] U.S. Cl. ..... 222/570; 220/694

[58] Field of Search ..... 222/570, 475, 465.1, 222/694; 220/855 P, 698, 94 A, 287

[56] References Cited

U.S. PATENT DOCUMENTS

| | | | |
|---|---|---|---|
| 2,802,609 | 8/1957 | Donovan | 222/570 |
| 2,837,256 | 6/1958 | Daner | 220/90 |
| 2,873,052 | 2/1959 | Atherton | 222/570 |
| 3,016,169 | 1/1962 | Kirshenbaum | 220/90 |
| 3,252,635 | 5/1966 | Rosenhan | 222/569 |
| 3,272,395 | 9/1966 | Lawyer | 220/90 |
| 3,309,000 | 3/1967 | Halverstick | 222/570 |
| 3,356,266 | 12/1967 | Pinter, Jr. | 222/570 |
| 3,366,272 | 1/1968 | Ballmann | 222/570 |
| 3,428,213 | 2/1969 | Stephens | 220/90 |
| 3,695,488 | 10/1972 | Olsson | 222/570 |
| 3,899,107 | 8/1975 | Gaal | 222/570 |
| 4,736,874 | 4/1988 | Durant | 222/570 |
| 4,907,714 | 3/1990 | Gatz | 222/570 |

*Primary Examiner*—Michael S. Huppert
*Assistant Examiner*—Philippe Derakshani
*Attorney, Agent, or Firm*—Gordon K. Anderson

[57] ABSTRACT

A pouring extension for a liquid containing can which has a hollow cylindrical body (20) with an outward flare (24) on the top and an inverted cone shape (30) on the bottom. A number of outwardly extending projections (34) are formed integrally with the bottom portion of the body allowing the extension to be inserted into open can and snapping into place on the internal bead of the can. The rigidity of the body in combination with the tapered shape and fit of the projections creates a hermetic seal retaining the extension in the can allowing the contents to be poured without contaminating the rim of the can. The extension may be tilted to pour all of the paint over the inside bead of the can and the tapered configuration allows use with all nominal size cans regardless of the diametrical tolerance.

7 Claims, 2 Drawing Sheets

POURING EXTENSION FOR CANS

TECHNICAL FIELD

The present invention relates in general to an apparatus for insertion into the mouth of an open can for pouring liquid contents. More specifically, to a liquid containing can pouring extension readily insertable at an angle enabling the entire contents to be drained, also adaptable to different diameter cans having the same nominal size.

BACKGROUND ART

There have been many types of paint can extension adaptors developed in endeavoring to provide an effective means for pouring paint from a can to avoid paint from remaining in the groove of the rim and also running over the edge onto the side of the can. In an attempt to fill this need, a myriad of devices have been developed for this purpose, however, in most cases a tapered spout has been used in conjunction with the seal or the body so designed as to use the rim of the can as the interface to either snap onto the groove or grip the outside periphery of the can at the bead.

A search of the prior art did not disclose an patents that read directly on the claims of the instant invention, however, the following U. S. patents were considered related:

| U.S. Pat. No. | Inventor | Filing Date |
|---|---|---|
| 4,736,874 | Durant | Apr. 12, 1988 |
| 3,899,107 | Gaal | Aug. 12, 1972 |
| 3,695,488 | Olsson | Oct. 3, 1972 |
| 3,366,272 | Ballmann | Jan. 30, 1968 |
| 3,356,266 | Pinter, Jr. | Dec. 5, 1967 |
| 3,309,000 | Haverstick | Mar. 14, 1967 |
| 3,252,635 | Rosenhan | May 24, 1966 |
| 2,873,052 | Atherton | Feb. 10, 1959 |
| 2,802,609 | Donovan | Aug. 13, 1957 |

Durant, in U. S. Pat. No. 4,736,874, teaches a wedge shaped annulus relying on frictional engagement with the inner rim of the can. A disposable paper spout is employed that is inserted into the wedge shaped spout allowing the annulus to remain clean and operable. Two separate elements are required to allow the functional procedure to be accomplished.

U. S. Pat. No. 3,899,107 issued to Gaal utilizes a resilient elastic retainer section which is channel shaped and adapted to snap over the outer peripheral bead of the container. A locating V-shaped rib extends into the groove of the can forming a seal. A paint brush supporting member is provided to support the bristle section of a brush when not in use and acts as a scraper to wipe excess paint from the brush.

Olsson, in U. S. Pat. No. 3,695,488, has gained wide acceptance of a spout consisting of a one piece pliable plastic member that has a base having an arcuate groove with a radius of curvature larger than the mating container lip allowing attachment within the cans inner bead. The device is flexed to a generally U-trough configuration and forced into the lip of the container forming a semicircular chute for pouring liquid from a container.

Ballmann teaches a painters accessory, in U.S. Pat. No. 3,366,272, that grips a paint can on both the outside wall the the upper groove. An elastic band frictionally secures the device to the wall allowing an adjustable relationship to the particular can. A gasket deformed into the can groove prevents ingress of liquid paint into this critical area.

U.S. Pat. No. 3,356,266 of Pinter, Jr. approaches the problem by attaching a lip structure that frictionally engages the upper extremity of a liquid container side wall. A leg, with a hook, covers the can lip inner bead and groove preventing liquid from entering, and a pour spout is formed into the lip structure to direct the liquid flowpath.

Rosenhan, in U.S. Pat. No. 3,252,638, inserts an extension collar that includes a pliable thin-walled neck portion which is manually distorted engaging a paint can inner bead locking into place by the resiliency of the parent material. An integral bead directly below the thin walled portion permits a seal to be made between the collar and the can. The device is manipulated by the users thumbs and fingers so as to be reversed inwardly allowing insertion into the can. Polyethylene teflon, rubber, or neoprene are preferred materials, as resiliency and flexibility are paramount in the functional characteristics of the invention.

For background purposes and as indicative of the art to which the invention relates, reference may be made to the remaining cited patents of Haverstick, Atherton, and Donovan.

It may be concluded that the use of pouring spouts or extensions has been limited, in most cases, to grasping a can either on the outside or inside of the lip or even both by a resilient material allowing it to snap over or in the rim utilizing the elastic nature of the material for the seal.

DISCLOSURE OF THE INVENTION

It is easily seen that the need for a simple pouring extension for a liquid container, such as a paint can, has been long felt as indicated by the depth of the prior art previously discussed. While using the principle of resiliency of material to attach the extension or spout has been the norm, some problems have been created by this approach, as it has been found that in the United States cans from individual manufacturers are not completely interchangeable and vary within the nominal dimensions. An investigation revealed that in the smaller sizes of cans a variation of up to 0.25 inches (0.64 cm) in diameter existed between manufacturers in the same nominal size. While this difference has little relevance to the public, as both can and lid are produced by the same manufacturer, an adapter to be used after the cans are distributed is another matter. Since most of the prior art relies on a fit and seal employing the resilient nature of the material, not all of the cans available fit exactly as designed and potential problems arise at inappropriate times, particularly if it occurs during the pouring of paint. It is, therefore, a primary object of the invention to fit all cans of the same nominal size with a universal extension that employs a wedging principle pushing the device into the can utilizing the taper of the device interfacing with the inner lip of the can. As the tapered body is concentric, the extension does not have to be centered in the can, actually this feature allows the device to be attached purposely offset or out of perpendicular alignment allowing all of the liquid to be poured without being trapped between the can lip and the pouring apparatus regardless of the actual diameter of the can.

An important object of the invention is directed to the ability of the invention to temporarily seal the can when the pouring extension is in place. This is accomplished by loosely placing the lid, preferably paint side down, inside the extensions tapered body with the lid sealing by gravity against the inside of the cone making a tight enough seal as to not evaporate volatiles within the contained liquid. Further, to remove the lid, an edge is pressed down into the cone lifting the opposite edge for access. If care is taken, the edge of the lid will not be covered with paint and the lid may be handled without touching the paint remaining on the inside surface.

Another object of the invention is the ability of the extension to keep paint out of the seal while providing a convenient pouring spout. If this area of a can remains clean and free of paint, the integrity of the seal is retained when the lid is replaced. In long term storage, the contents of the can could be rendered useless if evaporation is allowed to take place due to paint build-up in even one side of the sealing area thereby permitting air to enter and vapors to leave with normal ambient pressure differentials.

Still another object of the invention is the ease of installation as the extension is placed into the open can and pushed gently until the projections on the sides snap into place. In most cases, prior art requires rather substantial manipulation by hand in order to make the seal fit into the lip or bead. This is particularly difficult if the can is completely filled with liquid. Removal of the invention is also easily accomplished, as the projections locking the device in place are very small and are overcome by a slight flex inward with ones fingers pointed toward each other on the sides of the flared body and simply lifting upward.

Yet another object of the invention is the ease in which it may be cleaned. Prior art, in many cases, employs ridges, ribs, recesses, etc., to grasp the can bead or groove. Obviously, cleaning this type of device is difficult, as paint or liquid that is present in an indentation of any type is hard to remove. Since the pouring extension is basically rigid in structure and smooth on the contour with only small projectures on each side, cleaning is accomplished with ease and dispatch. No special procedure is required other than the normal cleaning for the liquid contained within the can.

Finally, time is saved by the user in not only the clean-up but in the ability to later identify the contents of the can as overruns or spills do not obliterate the description on the label or markings.

The top of the flare 24 provides a convenient edge upon which to rake the paint off a stirring paddle or stick.

When the paint in the can is being stirred, the inserted invention protects the seal of the can from any paint that may slop over in the stirring process.

These and other objects and advantages of the present invention will become apparent from the subsequent detailed description of the preferred embodiment and the appended claims taken in conjunction with the accompanying drawings.

BEST MODE FOR CARRYING OUT THE INVENTION

Figure 1:
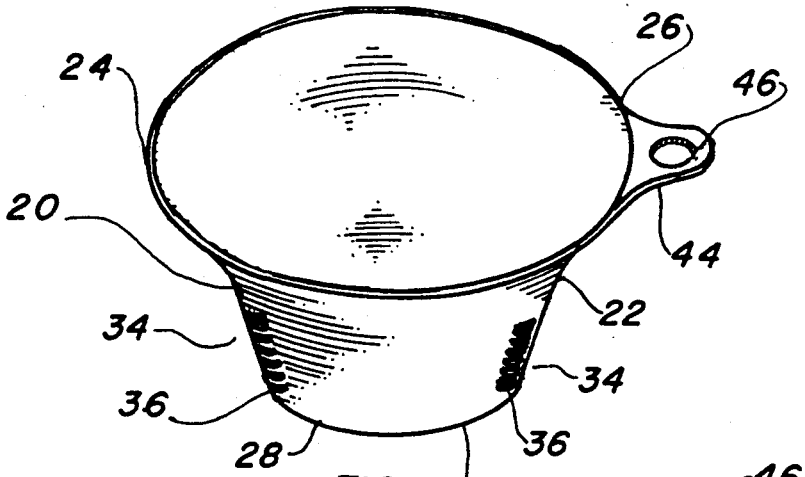
FIG. 1 is a partial isometric view of the preferred embodiment.
Figure 2:
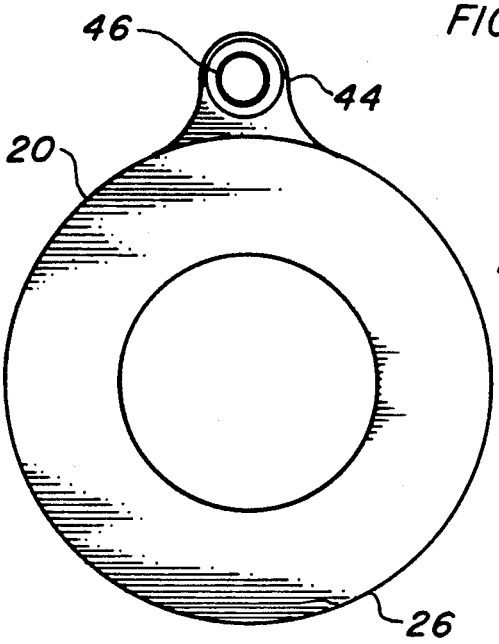
FIG. 2 is a top view of the preferred embodiment.
Figure 3:
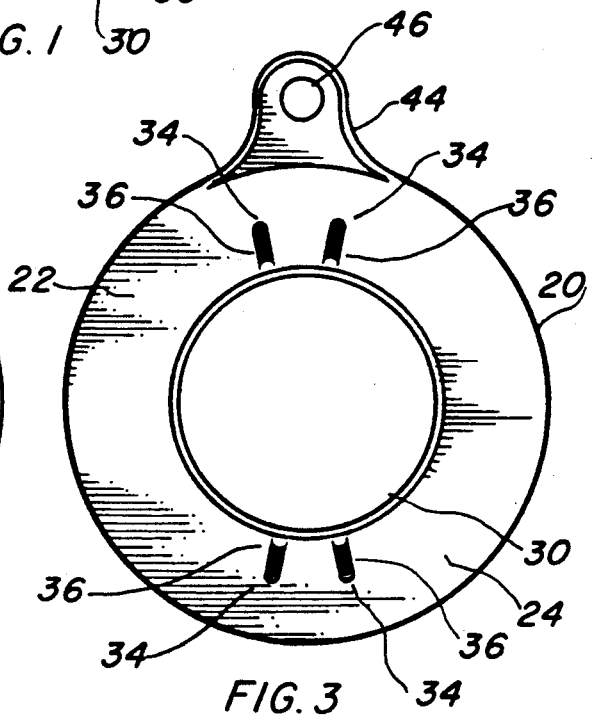
FIG. 3 is a bottom view of the preferred embodiment.

The best mode for carrying out the invention is presented in terms of a preferred embodiment with various alternate forms of projections to attach the invention to the can. The preferred embodiment, as shown in FIGS. 1 through 13, is comprised of a rigid cylindrical body 20 molded of thermoplastic having the inherent physical characteristics of rigidity, yet conformable due to the thin wall nature of the cylindrical shape. The upper portion 22 of the body 20 contains an outward flare 24 providing a radially contoured surface allowing the liquid contents of the can to be poured evenly with control and visual regulation. The extremity of the flare 24 terminates with a tapered end 26 that averts the liquid contained in the can from dripping when pouring is completed.

The lower portion 28 of the body 20 is integrally formed as a concentric truncated and inverted cone 30, dimensionally compatible with nominal sized cans, permitting insertion into the internal annulus 32 of an opened can. In the United States three sizes of cans are popularly used that are particularly benefited by use of this invention, a gallon, quart, and pint. The industry has not unitedly standardized the diameter of the opening and lid even though the volumetric contents are the same. This variation in diameter is overcome by the taper on the cone 30, as where the intersection actually occurs is of little moment in the integrity of the seal, as the cone 30 simply is inserted deeper or shallower, as required. Obviously, as the nominal dimensions of the cans differ immensely, no universal size will fit all cans, however, in the specific range it has been found that the invention functions with all known manufacturers configurations in the above noted common size range.

Figure 7:
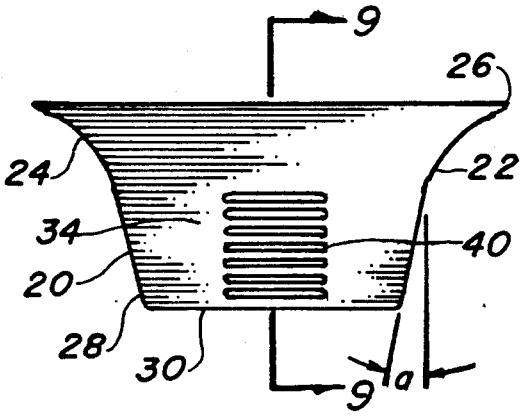
FIG. 7 is a side elevation view of the preferred embodiment illustrating the longitudinally extending radial end welt embodiment.
Figure 8:
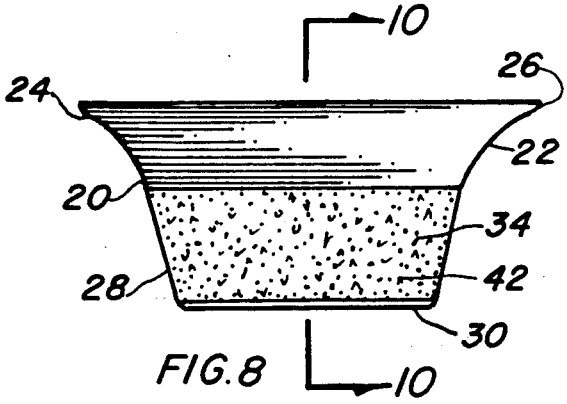
FIG. 8 is a side elevation view of the preferred embodiment illustrating the textured surface embodiment.
Figure 9:
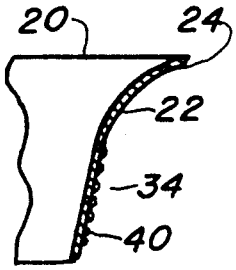
FIG. 9 is a cross-sectional view taken along lines 9—9 of FIG. 7.
Figure 10:
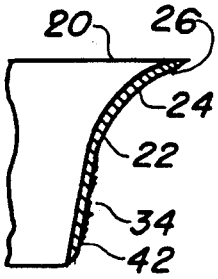
FIG. 10 is a cross-sectional view taken along lines 10—10 of FIG. 8.
Figure 11:
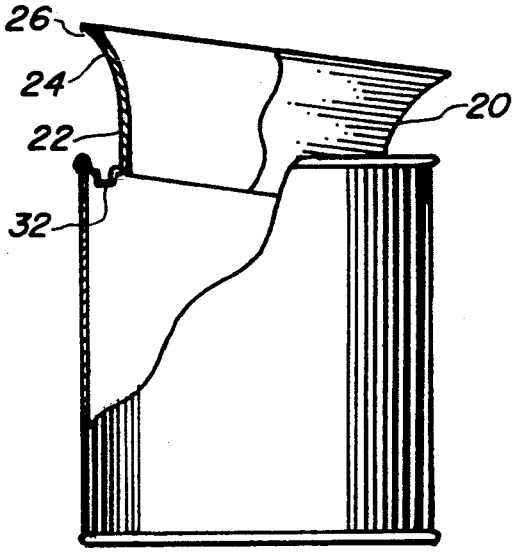
FIG. 11 is a front elevational view of the preferred embodiment installed into a liquid container, each partially cut-away for clarity.
Figure 12:
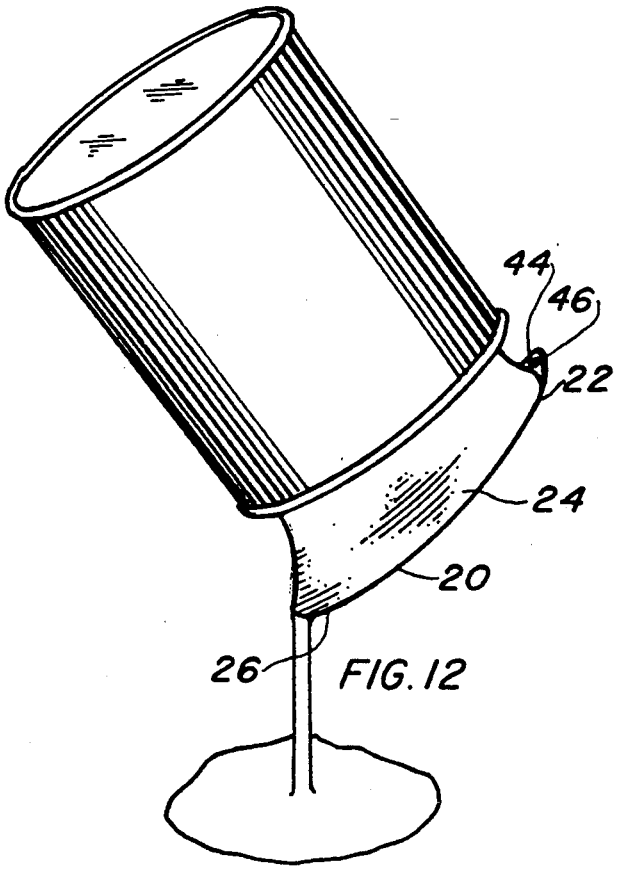
FIG. 12 is a partial isometric view of the preferred embodiment inserted in a can with contents of the container being poured from the extension flared end.

In order to overcome this anomalty in size, it has been established that the inward taper of the body 20 is ideal when the angle of the taper is from 8 to 14 degrees on the lower portion 28, as shown in FIG. 7 designated "a". Further, in order to permit the entire contents of the can to be emptied, the extension may be either originally inserted or relocated later on an angle relative to the can. This relationship is illustrated in FIGS. 11 and 12 and is seen in the cut-away section of FIG. 11, this angularity allows the entire contents of the can to be emptied completely. Further, this angular displacement is permitted without affecting the integrity of the seal, as the taper is uniform and the extension is thin enough to easily bend into an oval shape due to the resilient nature of the thermoplastic material and its cone shape.

In order to assist in retaining the body 20 in the internal annulus of the can during the pouring process, a plurality of outwardly extending projections 34 are formed into the body on opposed sides of the lower portion 28. These projections 34 are illustrated in various forms in FIGS. 1 and 3 through 10 and function equally well, however, more than one embodiment may be used equivalently and, therefore, this invention is not limited to a single form or externalization.

Figure 4:
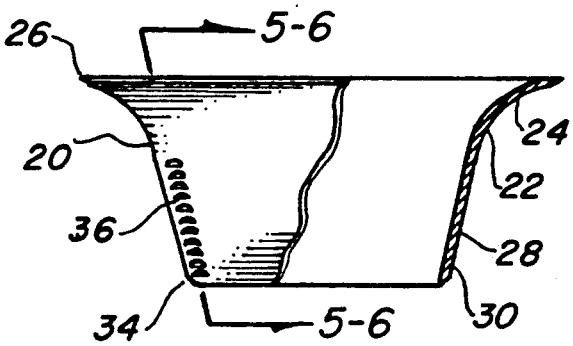
FIG. 4 is a side elevation view of the preferred embodiment partially cut-away depicting the cross-section of the structure.
Figure 5:
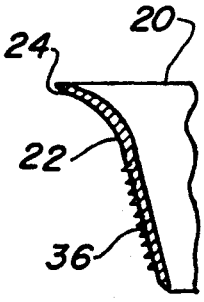
FIG. 5 is a cross-sectional view taken along lines 5—5 of FIG. 4 illustrating the outwardly extending projections in the triangular shape rigid tooth embodiment.

FIGS. 4 and 5 depict a vertical row of ridged teeth 36 in triangular shape. These teeth 36 preferably are one above the other on the outside surface of the cone 30, much like a ladder, and are raised only slightly above the surface of the device. When the teeth engage the internal annulus of the can, the tooth incident with the outside diameter snaps into place. As the extension does not need to be level, the exact opposite does not have to be utilized, actually the containment is assured at any combination from level to the maximum the tolerance of the can requires. In the prior art known at this time, this distinction is not duplicated in any form as being level is the norm and the tolerance in size of the can is not fully addressed. Small increments of tilt from one point above the corresponding point, or in actuality one tooth 36, to the other will allow a fine adjustment in angle, while still maintaining the required seal.

Figure 6:
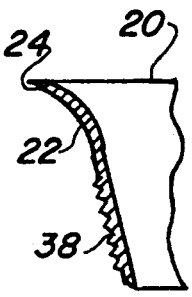
FIG. 6 is a cross-sectional view taken along lines 6—6 of FIG. 4 illustrating the outwardly extending projections in a cone shaped embodiment.

Another embodiment, shown in FIG. 6, is a vertical row of cones 38 each independent of the other, functioning as above, except the physical configuration is slightly different. Yet, another embodiment, illustrated in FIGS. 7 and 9, employs a vertical row of longitudinally extending radial end welts 40, again the function is the same. A further embodiment, depicted in FIGS. 8 and 10, instead of a row, a multiplicity of textured projections 42 are used. These projections are formed together, much like a rough texture with random projections on the entire surface While the function is basically identical, no specific individual projections are selected, instead those that are in alignment for the given amount of pressure and the tilt angle of the pouring extension are employed.

For the embodiments that have a row of projections, such as shown in FIGS. 5 and 6, it has been found that for stability a pair of projections on each opposed side are best suited for the application. This allows effortless positioning of the cone 30 into the can procluding sensitivity of alignment, as the bead of the can slips over the conical portion 28 until it is stopped by the appropriate set of opposed projections 34.

Even though a number of embodiments are taught to reassure a positive grip on the can, the invention is not limited to those shown, as an. infinite number of outwardly extending projections that permit angular alignment may be used with equal ease and does not affect the overall novelty of the invention.

A radial tab 44 formed integrally within the body 20 at the upper portion 22 provides a handle for gripping and to facilitate adjustment. Further, this tab 44 presents the operator a visual reference to the position of the position of the projections 34 particularly when the embodiment is in pairs. For uniformity in pouring, the tab 44 also provides indication as to which edge is to be used for pouring minimizing cleaning and waste of paint or the liquid contents if allowed to dry in place.

A hole 46 centrally located in the tab 44 provides a convenient receptacle for a hook, or the like, for hanging during storage or for merchandising display.

While the pouring extension may be made of any material, it is preferred that a thermoplastic is employed. This material allows the fabrication technique of injection molding to be used which is cost effective in large quantities and the finished product is smooth on the outside and inside surface making it easy to clean and the structure is rigid yet pliable enough to allow a slight deformation for attachment. Any suitable thermoplastic may be used, such as polyethylene, nylon, polycarbonate, ABS, phenolic, acrylic, polyimide with polypropylene being preferred.

Figure 13:
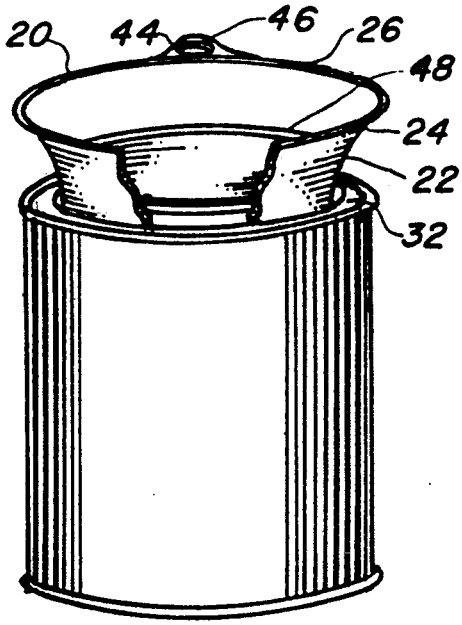
FIG. 13 is a cut-away partial isometric view of the invention installed in a container with the container lid positioned in the body for temporary closure.

FIG. 13 illustrates the paint can lid 48 loosely placed in the pouring extention 20, preferably paint side down. The taper"a" of the extension lower portion 28 allows the lid 48 to seal by gravity against the inside surface, further allowing the lid 48 to be easily removed by pressing down on the edge while maintaining an adequate temporary seal.

While the invention has been described in complete detail and pictorially shown in the accompanying drawings, it is not to be limited to such details, since many changes and modifications may be made in the invention without departing from the spirit and the scope thereof. Hence, it is described to cover any and all modifications and forms which may come within the language and scope of the appended claims.

I claim:

1. A pouring extension for a liquid containing can which has a top internal annulus gripping a pry-off top comprising:

a rigid cylindrical body having a upper portion and a lower portion, an outward flare integral with the upper portion of the body providing a contoured surface conducive to manageable liquid pouring, a concentric truncated and inverted cone integral with the lower portion of the body dimensionally compatible with nominal sized cans permitting insertion within the internal annulus of the opened can at an angle allowing the entire contents to be emptied, a plurality of equispaced outwardly extending diametrically opposed projections on the lower portion of the body, and said outwardly extending projections further comprise; a vertical row of ridged teeth in triangular shape enabling the body to be gripped at an angle and retained by the can while maintaining a hermetic seal therebetween.

2. The pouring extension as recited in claim 1 further comprising; said body formed from thermoplastic having the characteristics of rigid conformability.

3. The pouring extension as recited in claim 2 further comprising; injection molded ployprepylene as the termoplastic.

4. The pouring extension as recited in claim 1 further comprising:

a tapered end on the flare of the upper portion of the body to prevent liquid drips from being retained on the body when pouring is completed.

5. The pouring extension as recited in claim 1 further comprising an inward taper on the lower portion of the body of from 8 to 14 degrees.

6. The pouring extension as recited in claim 1 further comprising; a radial tab formed integrally within the body at the upper portion for grasping thereon while handling.

7. The pouring extension as recited in claim 6 further comprising; said radial tab having a centrally located hole therein for hanging during storage.

* * * * *